US006014957A

United States Patent [19]

Robinson

[11] Patent Number: 6,014,957

[45] Date of Patent: Jan. 18, 2000

[54] FUEL PUMP MODULE FOR THE FUEL TANK OF AN AUTOMOTIVE VEHICLE

[75] Inventor: Barry Robinson, Williamsburg, Va.

[73] Assignee: Siemens Automotive Corp., Auburn Hills, Mich.

[21] Appl. No.: 08/757,868

[22] Filed: Nov. 27, 1996

[51] Int. Cl.[7] ..... F02M 37/04

[52] U.S. Cl. ..... 123/509; 417/363; 137/590

[58] Field of Search ..... 123/509, 514, 123/495; 137/565, 590; 417/363

[56] References Cited

U.S. PATENT DOCUMENTS

| | | | |
|---|---|---|---|
| 3,470,907 | 10/1969 | Shockey | 137/590 |
| 4,569,637 | 2/1986 | Tuckey | 417/363 |
| 4,694,857 | 9/1987 | Harris | 137/565 |
| 4,844,704 | 7/1989 | Jiro | 123/509 |
| 4,869,225 | 9/1989 | Nagata | 123/509 |
| 5,038,741 | 8/1991 | Tuckey | 123/509 |
| 5,080,077 | 1/1992 | Sawert | 123/509 |
| 5,195,494 | 3/1993 | Tuckey | 123/514 |
| 5,482,444 | 1/1996 | Coha | 417/363 |
| 5,522,425 | 6/1996 | Kroiss | 137/590 |
| 5,613,476 | 3/1997 | Oi | 123/509 |

*Primary Examiner*—Carl S. Miller

[57] ABSTRACT

The automotive fuel pump module includes a sealed housing containing a fuel reservoir and a fuel pump for mounting within the fuel tank of a vehicle. A flange is secured to the wall of the fuel tank and lies in communication with the outlet of the fuel pump by a pair of pivotally connected arms for flowing fuel from the reservoir within the housing to outside of the fuel tank and to the fuel rail. A torsion spring biases the arms such that the reservoir body is referenced to the bottom of the fuel tank from the flange of the module. A pressure regulator may be provided within the housing for returning excess fuel to the reservoir. A mounting cup includes a pocket for receiving a pin on the housing cover for vibrationally isolating the pump and housing from one another and preventing rotation of the pump relative to the housing.

15 Claims, 4 Drawing Sheets

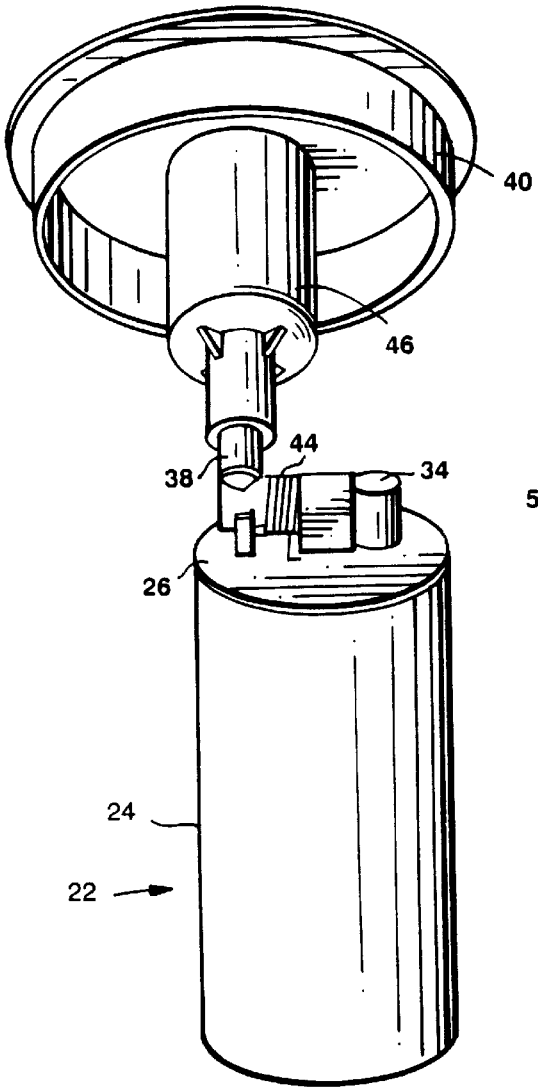
Fig. 4
Fig. 5
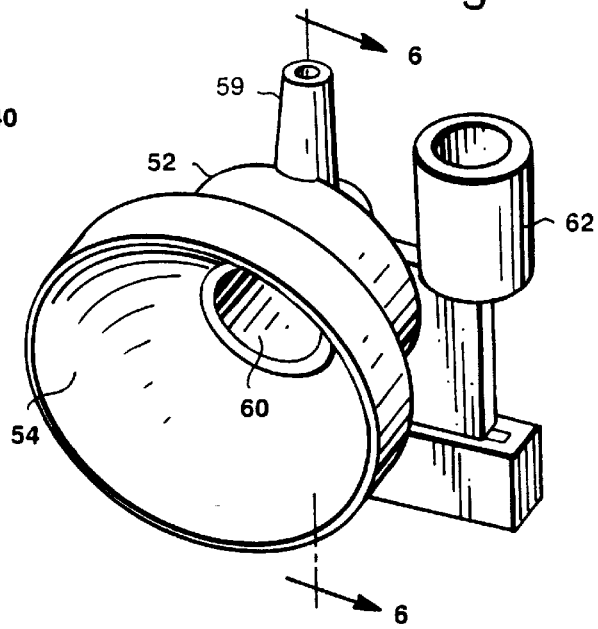
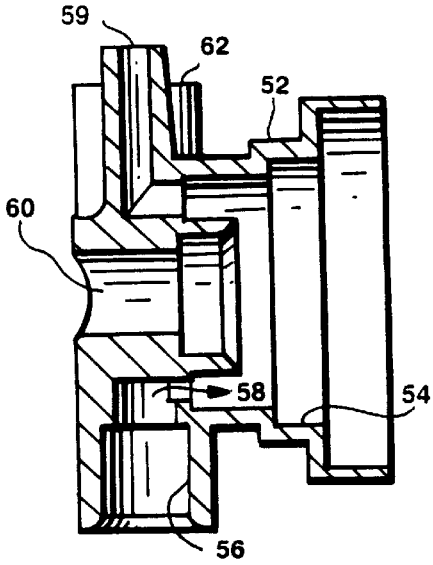
Fig. 6

FUEL PUMP MODULE FOR THE FUEL TANK OF AN AUTOMOTIVE VEHICLE

TECHNICAL FIELD

The present invention relates to a fuel pump module for disposition within the fuel tank of an automotive vehicle and particularly to a fuel pump module which has fewer parts count than known fuel pump modules and is therefore less costly to fabricate and assemble.

BACKGROUND

In automotive vehicles, a fuel pump is typically disposed within the fuel tank. The fuel pump inlet is typically referenced to the bottom of the fuel tank in order to prevent interruption of fuel flow to the engine when the fuel in the fuel tank is low or nearly empty. In certain fuel pumps, the pumps are located within the tank in a straight-up position, with an inlet spring-biased toward the bottom of the tank and having an associated filter. In a second type, the fuel tank inlet may comprise flexible lines which are clipped to the bottom of the fuel tank, the fuel pump being located outside of the fuel tank. In a still further form, a fuel pump module is disposed within a fuel tank and contains the fuel pump. The fuel pump module is pivotally connected to a flange secured to a wall of the fuel tank so that the pump is referenced to the bottom of the fuel tank. In one such construction of this latter type, the fuel pump module requires two structural members external to the module, i.e., a pivot arm and a guide arm, which also serve as fuel supply and fuel return lines, respectively. Also, a compression spring is used to load or bias the module to the fuel tank bottom. The fabrication and assembly of these structures are quite costly and the designs are not particularly robust, causing durability problems. Fuel contamination is also a problem because these designs have an opening permitting fuel to enter and leave the reservoir.

DISCLOSURE OF THE INVENTION

According to the present invention, there is provided a fuel pump module for an automotive vehicle which has reduced parts count, can be relatively easily manufactured and assembled, employs a torsion spring to reference the bottom of the fuel tank, includes a pressure regulator within the module and includes a regulator mount having vibration isolation and anti-rotation features. By mounting the fuel pressure regulator internal to the module housing, the need for a separate fuel return line is eliminated. The fuel return line is internal to the module housing for returning fuel to either a fuel reservoir within the housing or externally of the module to the vehicle fuel tank. The module also has a single external structural arm which serves as a fuel supply line. A torsion spring is disposed between the arm and the housing to bias the housing to the bottom wall of the fuel tank, the arm being connected to a flange connected to a structural wall of the fuel tank.

The present fuel pump module is less costly and easier to assemble than conventional pivot pump modules, has fewer parts, and enables the housing to be sealed from the fuel in the fuel tank with the exception of the fuel inlet to a reservoir within the module housing body, the module also housing the fuel pump. Sealing the reservoir to the outside world (the fuel tank) is desirable so that contaminants do not find their way to the fuel pump, causing damage. Where the fuel returned to the reservoir within the module housing body exceeds the fuel supplied to the fuel rail and the reservoir becomes full, a check valve is added to the housing to allow excess fuel to flow into the fuel tank.

It is a feature of the present invention that the regulator mounted within the module housing has a regulator mounting cup which serves as part of a fuel pump vibration isolation system, as well as an anti-rotational prevention mechanism. The regulator mounting cup is carried by the fuel pump and disposed within the module housing. The mounting cup includes a pocket for receiving a grommet formed along the underside of a cover sealed to the module housing body. The grommet and pocket are vibrationally-isolated one from the other, for example, by resilient material disposed therebetween. Also, the pocket and grommet are off the axis of the pump whereby the pocket and grommet combine to prevent rotation of the pump relative to the module housing. It will be appreciated that the opposite end of the fuel pump is likewise isolated vibrationally from the module housing body.

In a preferred embodiment according to the present invention, there is provided a fuel pump module for disposition in the fuel tank of an automotive vehicle to supply fuel to the engine of the vehicle, comprising a housing for disposition within the fuel tank including a fuel reservoir, a fuel pump within the housing for pumping fuel from the reservoir and having a fuel outlet, a flange for securement to the fuel tank, a member interconnecting the housing and the flange and having a passageway for receiving fuel from the fuel pump, the member including a first arm pivotally coupled to and disposed externally of the housing and a second arm connected to the flange and the first arm, the passageway extending through the first and second arms for flowing fuel from the reservoir to the engine of the vehicle and a torsion spring coupled between the arms for biasing the housing for movement relative to the flange for reference to a bottom of the fuel tank.

In a further preferred embodiment according to the present invention, there is provided a fuel pump module for disposition in the fuel tank of an automotive vehicle to supply fuel to the engine of the vehicle, comprising a housing for disposition within the fuel tank and including a fuel reservoir, a fuel pump within the housing for pumping fuel from the reservoir and having a rotational axis and a fuel outlet, a pressure regulator within the housing in communication with the outlet of the pump and having a port for returning fuel to the reservoir or the fuel tank, the regulator including a mount therefor for supporting the regulator on the fuel pump, the mount having a connection with the housing offset from the axis of rotation of the fuel pump, the mount connection including a pocket carried by one of the housing and the mount connection and a pin secured in the connection carried by another of the housing and the mount connection, one of the pin and the connection including a resilient element for vibrationally isolating the housing and the mount from one another.

In a still further preferred embodiment according to the present invention, there is provided a fuel pump module for disposition in the fuel tank of an automotive vehicle to supply fuel to the engine of the vehicle, comprising a housing for disposition within the fuel tank and including a fuel reservoir, a fuel pump within the housing for pumping fuel from the reservoir and having a rotational axis and a fuel outlet, a pressure regulator within the housing in communication with the outlet of the pump and having a port for returning fuel to the reservoir or the fuel tank, the regulator including a mount therefor for supporting the regulator on the fuel pump, the mount having a connection with the housing offset from the axis of rotation of the fuel pump and a flange for mounting the housing within the fuel tank and to a wall thereof, a unitary member extending between the flange and the housing and pivotally carried by the housing, and a torsion spring cooperable between the member and the housing for biasing the housing for movement relative to the flange for reference to a bottom wall of the fuel tank, the member constituting the sole structural connection between the flange and the housing and having a passage therethrough for flowing fuel from the fuel pump to the engine.

Accordingly, it is a primary object of the present invention to provide a novel and improved pivot pump module for the fuel tank of an automotive vehicle having reduced parts count and fabricating and assembly costs, an internal regulator and a fuel pump isolation and anti-rotation system.

BRIEF DESCRIPTION OF THE DRAWINGS

FIG. 4 is a side elevational view of the fuel pump module;

FIG. 5 is a perspective view of a mounting cup for the regulator within the fuel pump module housing; and FIG. 6 is a cross-sectional view taken generally about on line 6—6 in FIG. 5.

BEST MODE FOR CARRYING OUT THE INVENTION

Figure 1:
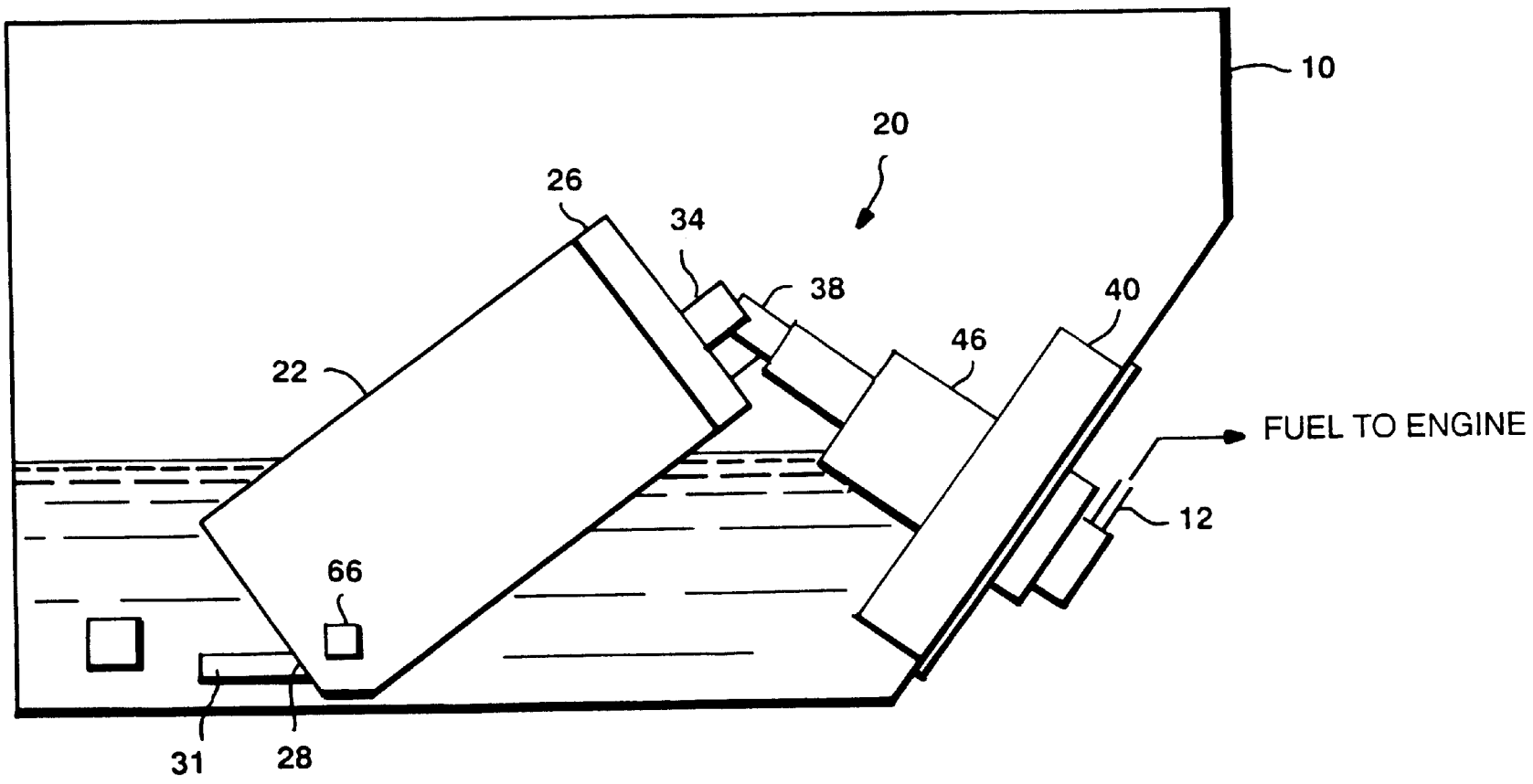
FIG. 1 is a schematic illustration of a fuel pump module according to the present invention, illustrated within the fuel tank of an automotive vehicle.
Figure 2:
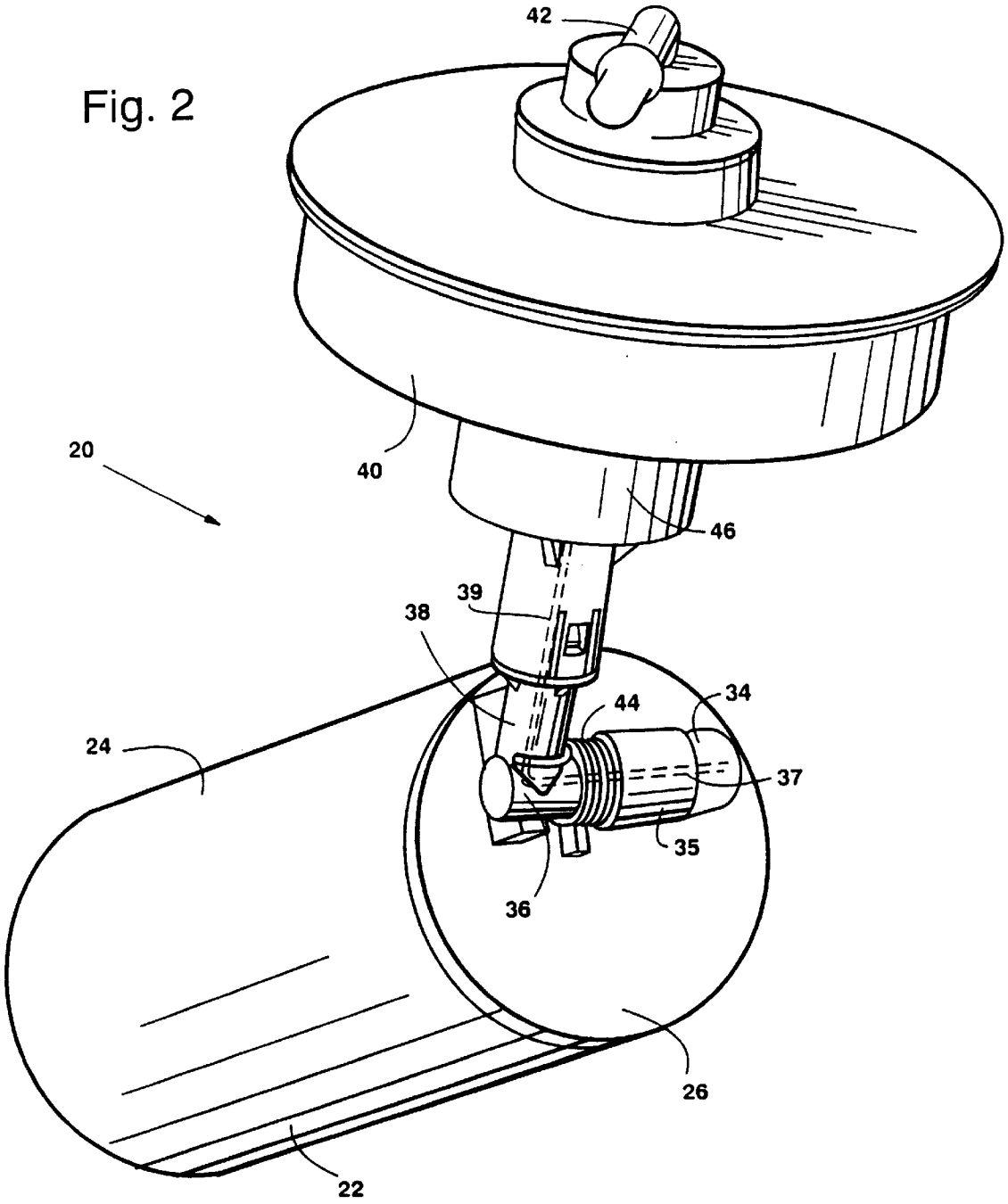
FIG. 2 is a perspective view of the fuel pump module hereof.

Referring now to the drawing figures, particularly to FIG. 1, there is illustrated a fuel tank 10 for an automotive vehicle for supplying fuel to a fuel rail which, in turn, supplies fuel to an engine through a plurality of fuel injectors. The fuel rail, injectors and engine are conventional in construction and are therefore not illustrated. The fuel system illustrated is a non-return system where there is a single fuel line 12 between the fuel pump module, generally indicated 20, within the fuel tank 10 and the fuel rail without the necessity of a return line from the fuel rail to the fuel pump module or fuel tank. In this form, a pressure regulator may be supplied in the fuel pump module as described below. Alternatively, the fuel pump module of the present invention may be provided in a fuel system having an integral returnless pressure regulator/filter at the inlet to the fuel rail, for example, as described and illustrated in U.S. Pat. No. 5,413,077 of common assignee herewith.

Figure 3:
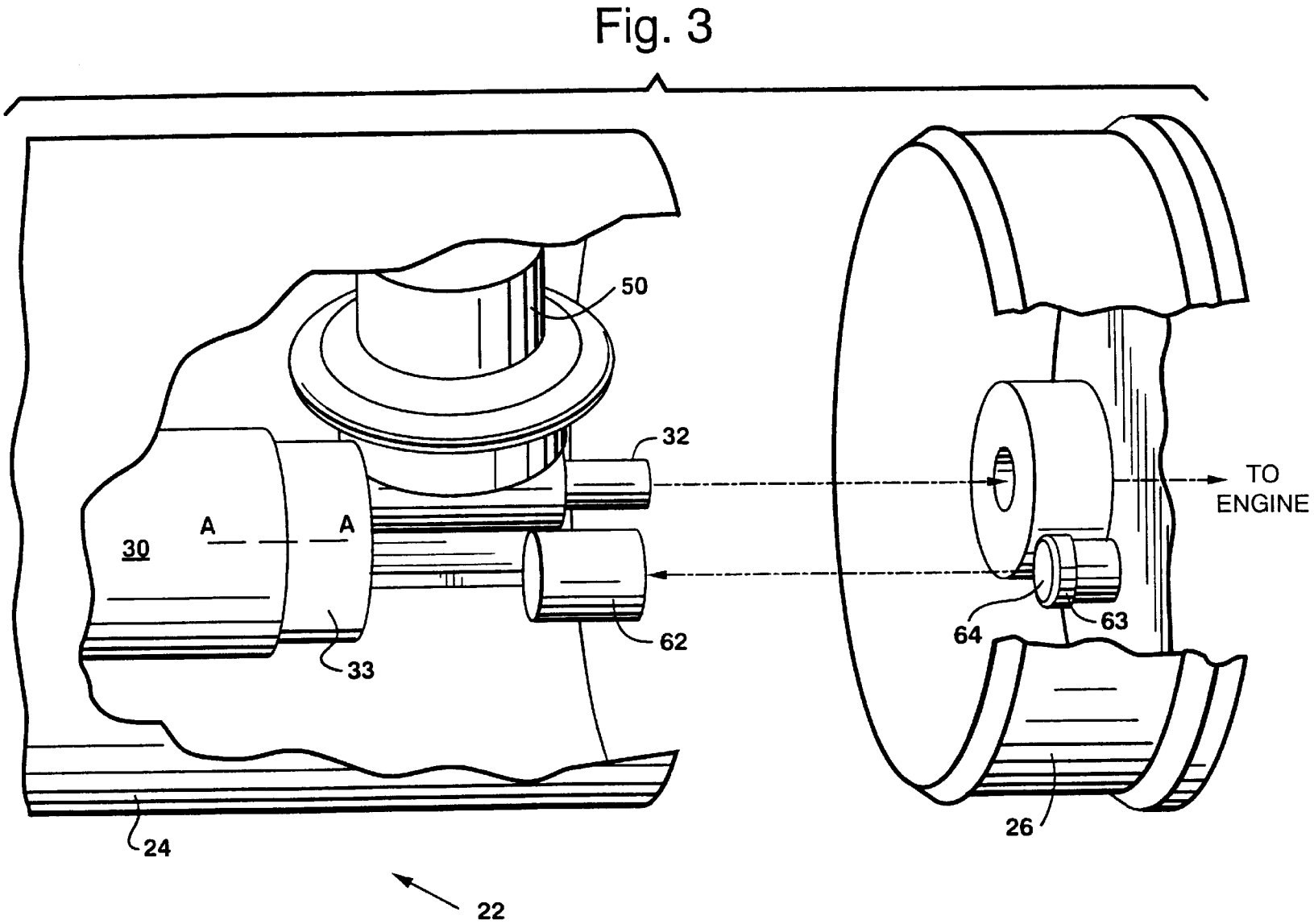
FIG. 3 is a partial perspective view with parts broken away of the fuel pump module hereof.

Referring now to FIG. 3, the pump module hereof comprises a housing, generally indicated 22, preferably of a generally cylindrical configuration but which may take other shapes as desired, having a cylindrical body 24 and a top or cover 26 and defining a fuel reservoir within body 24. Cover 26 is preferably suitably releasably sealed to body 24, e.g., by a snapfit and O-rings. Alternatively, the cover can be permanently attached to body 24, e.g., by welding of the plastic cover to the plastic body 24. Adjacent one end of the reservoir body 24 is a fuel inlet 28 (FIG. 1) having a fuel filter sock 31 whereby fuel from the fuel tank is admitted into the reservoir. In a returnless fuel system as herein, fuel is aspirated from the fuel tank into the reservoir within body 24 by flow of a fuel return line through a venturi, not shown, internal of the fuel pump module.

As illustrated in FIG. 3, there is provided a fuel pump 30 within reservoir body 24 and which fuel pump may be of conventional construction. For example, pump 30 may drive an impeller within a housing portion 33 about a rotational axis A—A generally parallel to the axis of cylindrical body 24 for pumping fuel to a fuel pump outlet 32. Suffice to say that the fuel pump pumps fuel from the internal reservoir of the module to the fuel pump outlet 32 for supplying fuel externally of the fuel tank by structure and passageways, to be described, to the fuel rail, not shown.

As shown in FIGS. 3 and 4, the fuel outlet 32 of the fuel pump 30 lies in communication with a fitting 34, mounted on top of cover 26, the fitting 34 being external to the housing 22. The fitting 34 has a socket 35 for receiving a first arm 36 pivotally mounted at one end within the socket 35. A second arm 38 is connected at one end to first arm 36 and at its opposite end to a flange 40. The flange 40 is suitably secured to the wall of the fuel tank 10 and mounts the fuel pump module 20 within the fuel tank 10 as illustrated in FIG. 1. second arm 38 contains a fuel passageway 39 in communication with passageway 37 through first arm 36 for flowing fuel from the fuel pump 30. The fuel passageways 37 and 39 through the arms 36 and 38, respectively terminate in a nipple 42 on the outer side of flange 40 and outside of the fuel tank for connection with a fuel supply line 12 for supplying fuel from the fuel pump module 20 to the fuel rail. Thus, arms 36 and 38 constitute a unitary member interconnecting the housing 22 containing the fuel pump 30 and reservoir on the one hand and the flange 40 coupled to the fuel tank 10 on the other hand whereby fuel can be pumped from the reservoir to the engine.

The housing 22 containing the fuel pump and reservoir is pivotally mounted to the arms 36 and 38 and structurally supported by the flange 40 so that the housing 22 can always be referenced to the bottom of the fuel tank. To accomplish this, a torsion spring 44 is coupled about the arm 36 and opposite ends of the torsion spring engage the arm 38 and the cover 26, respectively. The torsion spring 44 is mounted such that a constant bias is provided between the fixed support structure provided by the flange 40 and arm 38 to the housing 22 so that the housing 22 is biased for reference to the bottom of the fuel tank. Significantly, the sole structural support between flange 40 and the module housing 22 is the fitting 34 and arm 36 pivotally coupled to one another and through which the fuel supply line passes.

The flange 40 may have a fuel filter pocket 46 disposed along its underside for receiving a fuel filter, not shown. Alternatively, the fuel filter pocket may be located on the outside of the flange with a removable cover whereby access to the fuel filter can be provided from outside of the fuel tank. Referring to FIG. 3, a pressure regulator 50 may be provided within the housing 22, i.e., inside the fuel module. Thus, for example, where a returnless fuel system is employed, the necessary fuel return is provided through the pressure regulator for returning fuel to the reservoir. Thus, the fuel is pumped from the fuel pump to the fuel rail and the pressure regulator diverts excess fuel from the fuel supply line to the reservoir through an outlet of the pressure regulator. In a non-return fuel system which does not require a regulator, the regulator can be eliminated and replaced with a simple pressure relief valve, or if the system is deadheaded, then a fuel return is not necessary.

Referring now to drawing FIGS. 5 and 6, the pressure regulator which per se may be a conventional integral regulator is mounted within a regulator mounting cup 52 secured to an outlet port of the pump 30. The mounting cup 52 includes a series of circular steps 54 which receive the regulator, the regulator 50 not being shown in FIGS. 5 and 6 but being illustrated in FIG. 3. Fuel from the pump 30 passes through an inlet port 56 laterally outwardly through a port 58 into the regulator, with the fuel flowing from the regulator through the outlet port 59 in communication with the outlet 32. The return fuel from the regulator passes to the reservoir by way of an outlet port 60.

A significant aspect of the present invention resides in the provision of a regulator pocket 62 formed along one side of the regulator mounting cup 52 and preferably formed integrally with cup 52. Pocket 62 comprises a generally cylindrical nipple open at one end for receiving a grommet or pin 64 projecting from the undersurface of the cover 26 of the housing 22. The pin or interior portions of the pocket 62, or both, may be provided with vibration-isolation material, i.e., any known resilient material, for isolating the pump 30 from the body 24. Thus, vibration isolation material 63 may be disposed about pin 64. The opposite end of the pump 30 is likewise mounted in a resilient grommet, not shown, so that the pump is vibrationally isolated from the body 24. The pocket 62 and pin 64 are off-axis relative to the cylindrical body 24 such that the pocket and pin serve to prevent rotation of the pump 30 relative to the housing 22.

A further important aspect of the present invention is that the reservoir is sealed. To accomplish this, the cover 26 may be sealed to the body 24 via a welding operation or an O-ring may be used in a snapfit. Alternatively, a simple pressfit may be utilized. Sealing the reservoir from the fuel tank is desirable so that contaminants do not find their way to the fuel pump, causing damage. Should the fuel return exceed the fuel supplied and the reservoir becomes full, a check valve 66 can be added to the housing 22 to relieve excess pressure and return fuel to the fuel tank 10.

It will be appreciated that the objectives of the present invention are fully accomplished in the foregoing described fuel pump, particularly in that the parts count for the fuel pump module is substantially reduced as compared with prior fuel pump modules. For example, only a single structural connection comprised of two arms pivotally coupled one to the other between the structural support, i.e., the flange, and the module housing is necessary. The design also enables the mounting of a pressure regulator within the body 24, as well as a filter, as necessary. Moreover, the pocket 62 and pin 64 arrangement of the regulator mounting cup 52 and cover 26 vibrationally, in conjunction with grommet at the opposite end of the pump, isolate the fuel pump 30 from housing 22 while simultaneously preventing rotation of the fuel pump 30 relative to the housing 22. The torsion spring 44 also allows the reservoir to be referenced at all times to the bottom of the fuel tank for low fuel derivability and without the necessity of further structural interconnections between the flange 40 and the housing 22.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel pump module for disposition in the fuel tank of an automotive vehicle to supply fuel to the engine of the vehicle, comprising:

a housing for disposition within the fuel tank including a fuel reservoir;

a fuel pump within said housing for pumping fuel from said reservoir and having a fuel outlet;

a member interconnecting said housing and said flange and having a passageway for receiving fuel from said fuel pump, said member including a first arm pivotally coupled to and disposed externally of said housing and a second arm connected to said flange and said first arm, said passageway extending through said first and second arms for flowing fuel from said reservoir to the engine of the vehicle; and a flange for securement to the fuel tank;

a torsion spring coupled between said arms and said housing for biasing said housing for movement relative to said flange for reference to a bottom of the fuel tank.

2. A module according to claim 1 including a pressure regulator within said reservoir in communication with the outlet of said pump and having a port for returning fuel to said reservoir or the fuel tank.

3. A module according to claim 1 including a fuel filter carried by said flange.

4. A module according to claim 1 wherein said housing is sealed except for an inlet into said housing for receiving fuel from the fuel tank, said housing lying wholly within the fuel tank.

5. A module according to claim 1 wherein said arms constitute the sole structural connection between said flange and said housing.

6. A module according to claim 1 wherein said reservoir has a fuel inlet passage in communication with said tank and a fuel filter in said fuel inlet passage.

7. A module according to claim 1 wherein said housing has a body and a cover sealed to said housing body enclosing the fuel pump and reservoir, said first arm being pivotally carried by said cover and being angularly related to said second arm.

8. A module according to claim 1 including a fuel regulator within said reservoir in communication with the outlet of said pump and having a port for returning fuel to said reservoir or the fuel tank, said regulator including a mount therefor for supporting the regulator on the fuel pump, said mount including a connection with said housing for vibrationally isolating said pump and said housing.

9. A module according to claim 1 including a fuel regulator within said reservoir in communication with the outlet of said pump and having a port for returning fuel to said reservoir or the fuel tank, said regulator including a mount therefor for supporting the regulator on the fuel pump, said mount including a connection with said housing preventing rotation of said pump relative to said housing.

10. A fuel pump module for disposition in the fuel tank of an automotive vehicle to supply fuel to the engine of the vehicle, comprising:

a housing for disposition within the fuel tank and including a fuel reservoir;

a fuel pump within said housing for pumping fuel from said reservoir and having a rotational axis and a fuel outlet;

a pressure regulator within said housing in communication with the outlet of said pump and having a port for returning fuel to said reservoir or the fuel tank;

said regulator including a mount therefor for supporting the regulator on said fuel pump, said mount having a connection with said housing offset from the axis of rotation of the fuel pump, said mount connection including a pocket carried by one of said housing and said mount connection and a pin secured in said connection carried by another of said housing and said mount connection, one of said pin and said connection including a resilient element for vibrationally isolating said housing and said mount from one another.

11. A module according to claim 10 wherein said housing includes a body and a cover secured to said body, said pocket being carried by one of said body and said cover and said pin being carried by another of said body and said cover.

12. A module according to claim 10 wherein said housing includes a body and a cover secured to said body, said pocket being carried by one of said body and said cover and said pin being carried by another of said body and said cover, said mount having a mounting cup for said fuel regulator, an inlet for receiving fuel from said fuel pump, an outlet port for supplying fuel to the engine of the vehicle and a fuel return port for returning fuel to said reservoir or fuel tank, said mount being formed integrally of a plastic material.

13. A fuel pump module for disposition in the fuel tank of an automotive vehicle to supply fuel to the engine of the vehicle, comprising:

a housing for disposition within the fuel tank and including a fuel reservoir;

a fuel pump within said housing for pumping fuel from said reservoir and having a rotational axis and a fuel outlet;

a pressure regulator within said housing in communication with the outlet of said pump and having a port for returning fuel to said reservoir or the fuel tank;

said regulator including a mount therefor for supporting the regulator on said fuel pump, said mount having a connection with said housing offset from the axis of rotation of the fuel pump; and a flange for mounting said housing within the fuel tank and to a wall thereof, a unitary member extending between said flange and said housing and pivotally carried by said housing, and a torsion spring cooperable between said member and said housing for biasing said housing for movement relative to said flange for reference to a bottom wall of the fuel tank, said member constituting the sole structural connection between said flange and said housing and having a passage therethrough for flowing fuel from the fuel pump to the engine.

14. A fuel pump module for disposition in the fuel tank of an automotive vehicle to supply fuel to the engine of the vehicle, comprising:

a housing for disposition within the fuel tank and including a fuel reservoir;

a fuel pump within said housing for pumping fuel from said reservoir and having a rotational axis and a fuel outlet;

a pressure regulator within said housing in communication with the outlet of said pump and having a port for returning fuel to said reservoir or the fuel tank;

said regulator including a mount therefor for supporting the regulator on said fuel pump, said mount having a connection with said housing offset from the axis of rotation of the fuel pump, including a flange for mounting said housing within the fuel tank and to a wall thereof, a pair of angularly related arms connected to one another with one arm connected to said flange and another arm pivotally connected to said housing, and a torsion spring coupled between said another arm and said housing for biasing said housing for movement relative to the flange for reference to a bottom wall of the fuel tank.

15. A module according to claim 14 wherein said arms constitute the sole structural connection between said flange and said housing.

* * * * *